United States Patent [19]

Grahame

[11] Patent Number: 4,643,207

[45] Date of Patent: Feb. 17, 1987

[54] CUTICLE MANICURING DEVICE

[76] Inventor: Arnold Grahame, 225 Hillturn La., Roslyn Heights, Long Island, N.Y. 11577

[21] Appl. No.: 793,335

[22] Filed: Oct. 31, 1985

[51] Int. Cl.[4] ..... A45D 29/05

[52] U.S. Cl. ..... 132/73.6; 132/75.8; 132/76.4

[58] Field of Search ..... 132/73.6, 76.4, 73, 132/75.6, 75.8, 73.5; 30/26

[56] References Cited

U.S. PATENT DOCUMENTS

| | | | |
|---|---|---|---|
| 875,681 | 1/1908 | Asbury | 132/75.6 |
| 1,472,876 | 11/1923 | Larrûs et al. | 132/73.6 |
| 1,657,768 | 1/1928 | Sandford | 132/73.6 |
| 1,719,063 | 7/1929 | Lidseen | 132/73.6 |
| 1,814,625 | 7/1931 | Foerster | 132/73.6 |
| 2,236,096 | 3/1941 | Henry | 132/75.3 |
| 2,504,795 | 4/1950 | Biasi | 132/75.8 |
| 2,516,423 | 7/1950 | Roe | 132/75.6 |
| 2,880,737 | 4/1959 | Tone et al. | 132/73.6 |
| 2,917,056 | 12/1959 | Dolan, Sr. | 132/75.8 |
| 4,175,573 | 11/1979 | Burian | 132/73.6 |

FOREIGN PATENT DOCUMENTS

| | | | |
|---|---|---|---|
| 22391 | 7/1905 | Austria | 132/73.6 |
| 3022616 | 1/1982 | Fed. Rep. of Germany | 132/73.6 |
| 857595 | 9/1940 | France | 132/73.6 |
| 2547177 | 12/1984 | France | 132/73.6 |

*Primary Examiner*—Gene Mancene
*Assistant Examiner*—J. R. Hakomaki
*Attorney, Agent, or Firm*—Collard, Roe & Galgano

[57] ABSTRACT

A cuticle manicuring device is provided wherein a vibrating electrical motor is contained within an elongated, pencil shaped housing and wherein a manicuring implement extends axially from one end of the housing. The manicuring implement includes a vibrating stem driven by the vibrating motor and having a crescent shaped abrasive element disposed at the distal end thereof. A cuticle guide extends from the end of the housing parallel to the vibrating stem and is broad enough to provide support to the oscillating abrasive element. The tip of the guide is formed as a point and extends beyond the abrasive element so as to enter beneath the cuticle and provide a limit stop to the forward movement of the abrasive element. A cap is provided to fit over the manicuring implement to frictionally engage with the housing to be retained thereon. A retractable cuticle lifter is provided in the cover.

13 Claims, 8 Drawing Figures

FIG. 1
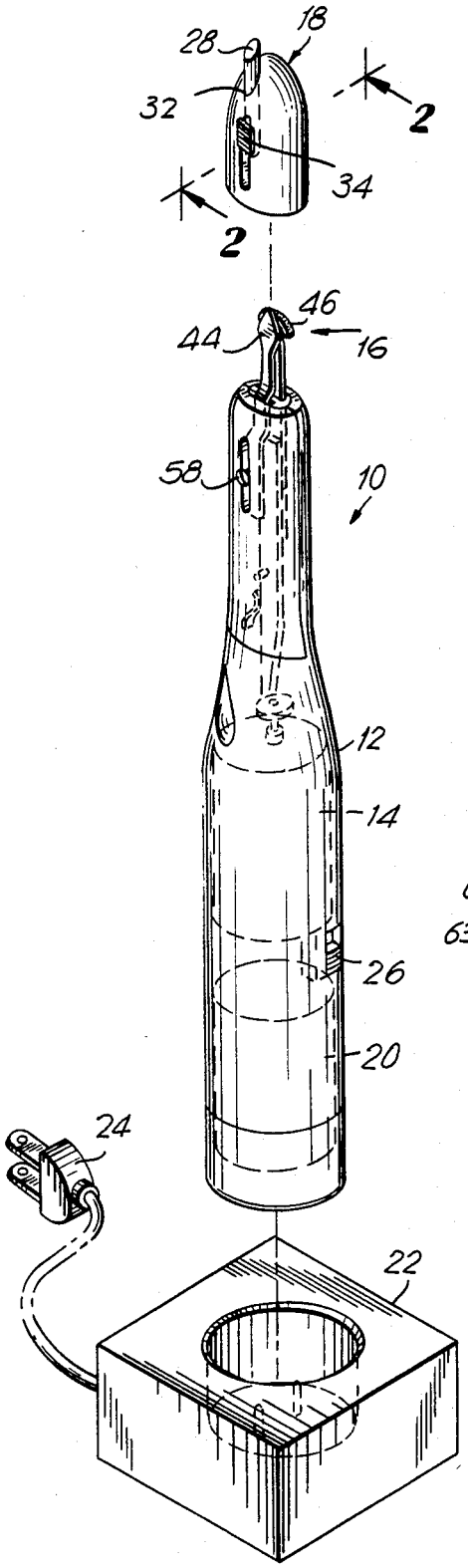
FIG. 2
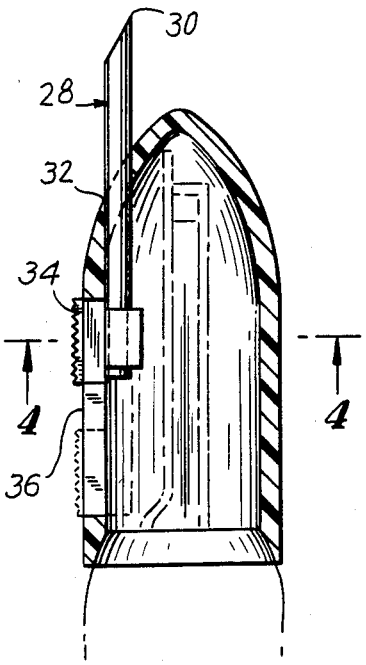
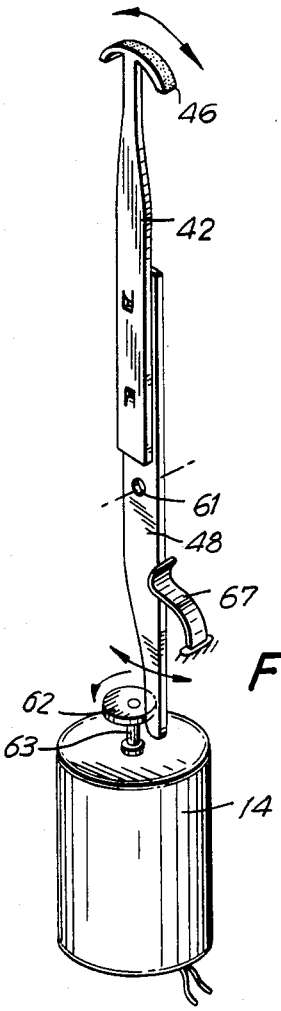
FIG. 3
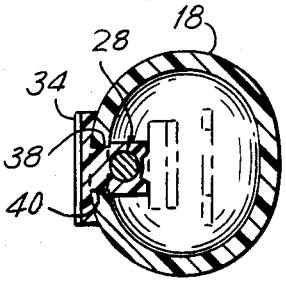
FIG. 4

CUTICLE MANICURING DEVICE

The present invention relates generally to a cuticle manicuring device and, more particularly, to an electrically powered cuticle manicuring device which trims the cuticle by means of an abrasive element.

In manicuring a person's hands, it is not only necessary to trim and shape the nails of the fingers, but to also trim the cuticles around the fingernails. Heretofore, it has been the practice by both professional manicurists as well as those who manicure their own hands to trim cuticles by means of cutting the cuticle with a sharp instrument such as a knife-like device or a scissors-type device. Obviously, when utilizing such an instrument, care must be taken so that living tissue adjacent to the cuticle is not cut or damaged.

In order to improve the manicuring operation, several power-operated devices have been developed for the trimming and shaping of fingernails and also for the trimming of cuticles. One example can be found in U.S. Pat. No. 3,420,250, to Holmes, granted Jan. 7, 1969, which discloses a hand-held tool with a self-contained motorized unit for rotatably driving a shaft onto which various implements for manicuring may be attached. The patent discloses that the device is adapted to drive nail files, cuticle tools, buffing pads and other manicuring implements but makes no specific disclosure as to how these implements operate except that logically they must operate in a rotatable manner since the output of the device is rotary. Also, there is no discussion concerning the prevention of damage or cutting of the epidermis or living tissue near the cuticle upon which a manicuring operation is being performed by the cuticle tool.

Another example of a powered or motorized manicuring device can be found in U.S. Pat. No. 2,936,768, to Chamberlain, granted May 17, 1960. The device disclosed in this patent is similar to an electric shaver and in fact one of the operations performed by the device in fact is shaving. Another operation utilizes the transverse movement of the vibratory drive to drive an element which includes sandpaper or emery cloth and is used to file nails. Another manicuring device is disclosed in U.S. Pat. No. 3,081,782, to Funk, granted Mar. 19, 1963. This patent discloses a modification or attachment for an electric razor which can be used to trim fingernails by means of a vibrating nail file or vibrating emery cloth, much as is done in the already discussed Chamberlain patent.

While the above discussed prior art patents are directed to manicuring by power operated mechanical means, their main thrust is directed to the power operated mechanical filing of fingernails. None of the discussed devices is directed to the manicuring of cuticles per se and thus can do so only inadequately. Thus, the one reliable means of cuticle manicuring is by hand with sharp cutting instruments. As pointed out above, the major problem in trimming cuticles, particularly by hand with sharp cutting instruments, is to prevent damage or cutting of the epidermis adjacent to the cuticle. Also, by trimming cuticles by means of cutting tools, the cuticles are left somewhat ragged with the result that they grow back in a rather ragged and uneven condition.

It is, therefore, an object of the present invention to provide a cuticle manicuring device which precisely and evenly trims the cuticle around a fingernail without giving rise to the danger of damaging or cutting the live tissue of the epidermis adjacent to the cuticle.

The above object is accomplished in accordance with the present invention by providing a motor driven cuticle trimmer wherein a motor is contained in a slender, hand-held, elongated housing having a vibrating stem axially extending from a first end of the housing which is driven by the motor. An arcuately-shaped, abrasive element is disposed at the distal end of the axially-extending stem which is caused to oscillate horizontally by the vibrating action of the stem. A guide is also provided axially extending from the first end of the housing which is parallel to, but offset from, the axially-extending stem and the tip of which extends beyond the abrasive element at the end of the stem. The guide is relatively broad beneath the abrasive element so as to provide a support therefor and its distal end is in the form of a point so as to fit beneath the cuticle. The length of the guide extending beyond the abrasive element acts as a limit stop for the abrasive element and serves to maintain the abrasive element in contact with the cuticle during the manicuring procedure.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views:

FIG. 1 is a partially-exploded, perspective view of the cuticle manicuring device of the present invention;

FIG. 2 is a cross-sectional view of a portion of the cuticle manicuring device of FIG. 1 taken along the line 2—2 of FIG. 1;

FIG. 3 is a perspective view of one embodiment of a motor driven, reciprocating abrasive element;

FIG. 4 is a cross-sectional view taken along the line 4—4 of FIG. 2;

Figure 5:
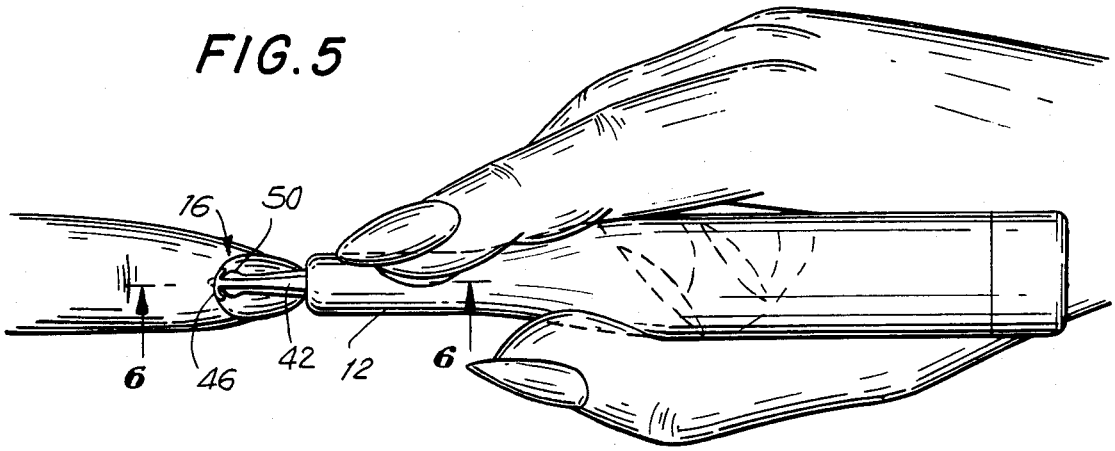
FIG. 5 is a plan view of the cuticle manicuring device of the present invention in operation.

Now turning to the drawings, there is shown in FIG. 1 a cuticle manicuring device, generally designated 10, comprising a hand-held housing 12 for a vibrating motor 14 (shown in phantom), a cuticle manicuring implement, generally designated 16, and including an abrasive element 46 and a cuticle guide 44, and a cap or cover 18 which fits over manicuring implement 16 to frictionally engage circumferentially with the sidewall at the end of housing 12 so as to be retained thereon. Preferably, housing 12 is substantially pencil shaped and adapted to be easily held by the hand and manipulated thereby to perform the designed functions of cuticle manicuring device 10. Vibrating motor 14 is contained within housing 12 and is electrically powered. The power for vibrating motor 14 may be supplied by means of a battery 20 (shown in phantom) contained within housing 12 or the power may be supplied by the house current by means of a cord and electrical plug extending from housing 12. As shown in detail in FIG. 3, vibrating motor 14 can be comprised of a DC powered motor having a shaft 63 on the end of which is a rotating cam 62. Cam 62 will have at least one flat surface for engagement to one end of a vibrating drive shaft 48 which is pivoted on axis 61. A spring 67 maintains drive shaft 48 in contact with cam 62. The rotation of cam 62 will cause abrasive element 46 to oscillate around axis 61. In the event that battery power is utilized, a recharging device can be provided, as shown in FIG. 1, and incorporated within a holder 22 and adapted to be plugged into the house current by means of electrical plug 24. An on/off switch, designated 26, is provided on housing 12 so as to control vibrating motor 14.

Cap 18 includes a retractable cuticle lifter 28 which is adapted to extend beyond the end of cap 18. Cuticle lifter 28 has an end 30 formed in the shape of a wedge for the purpose of probing beneath the cuticle of a fingernail and lifting the same in preparation for the manicuring or trimming thereof. Cuticle lifter 28 extends through an opening, designated 32, in cap 18 and is manipulated by means of a button 34 which is attached to cuticle lifter 28 and which extends through elongated axial slot 36 in cap 18. As seen in FIG. 4, button 34 is adapted to be slidingly retained on cap 18 at slot 36 by being provided with oppositely disposed grooves which engage with slot 36. As seen in FIG. 2, button 34 may be pushed forwardly in slot 36 to extend cuticle lifter 28, as seen in solid lines in FIG. 2, and it may be moved rearwardly to the position shown in phantom in FIG. 2 in order to retract cuticle lifter 28 within cap 18. Directional arrow A in FIG. 3 demonstrates the forward and rearward movements which may be imparted to button 34 to extend and retract cuticle lifter 28.

Figure 6:
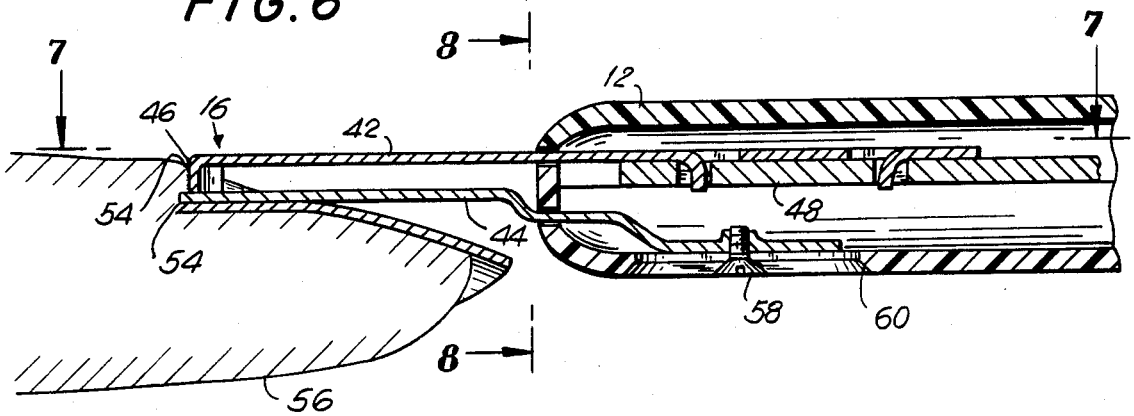
FIG. 6 is a cross-sectional view of the cuticle manicuring device taken along the line 6—6 of FIG. 5.
Figure 7:
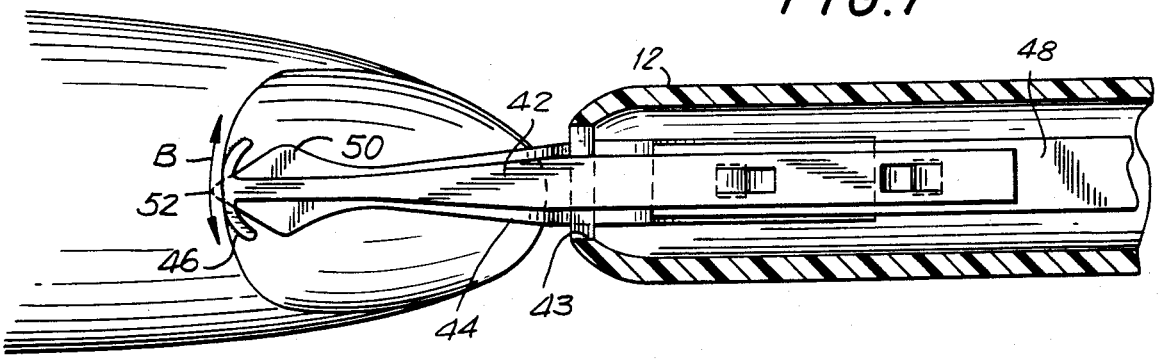
FIG. 7 is a cross-sectional view of the cuticle manicuring device taken along the line 7—7 of FIG. 6.
Figure 8:
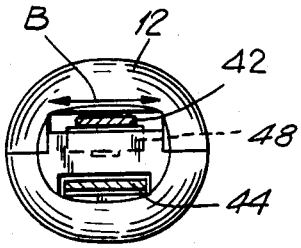
FIG. 8 is a cross-sectional view of the cuticle manicuring device taken along the line 8—8 of FIG. 6.

As seen in FIGS. 6 and 7, manicuring implement 16 is comprised of a vibrating stem, designated 42, and a cuticle guide, designated 44 which extend through opening 43 in the end of housing 12. Vibrating stem 42 is provided at its distal end with an abrasive element, designated 46, and is connected at its other end to vibrating drive shaft 48, which in turn is connected to vibrating motor 14. Abrasive element 46 is preferably crescent-shaped, as seen in FIG. 7, and can be of a diamond or sapphire dust construction. Crescent-shaped abrasive element 46 oscillates, as indicated by arrow B in FIGS. 7 and 8, due to the horizontal vibrations imparted to vibrating stem 42 by vibrating drive shaft 48. Abrasive element 46 is supported in these oscillations on cuticle guide 44, which is substantially flat and broad in a plane parallel to the plane of oscillation of abrasive element 46 so as to accommodate the oscillating movement of the abrasive element. The distal end 50 of cuticle guide 44 is substantially arrow-shaped so as to provide the broad planar support for abrasive element 46 and in order to provide a point 52 at the tip thereof. Point or tip 52 extends slightly beyond abrasive element 46 so as to extend beneath the cuticle 54 of finger 56, as clearly seen in FIG. 6, to thus limit the extent of forward travel or movement of abrasive element 46 against cuticle 54. Thus, with the forward extent of abrasive element 46 limited by tip 52 of guide 44, a very even manicure of cuticle 54 is accomplished by the oscillating movement of abrasive element 46. Forward adjustment of point or tip 52 of cuticle guide 44 is provided by adjustment screw 58 in longitudinal slot 60 of housing 12. Thus, by merely unscrewing adjusting screw 58 and sliding cuticle guide 44 forward or rearward along the track guide provided by slot 60, the desired extent of penetration of tip 52 under cuticle 54 can be achieved.

In operation, cuticle manicuring device 10 is grasped by the hand of the operator, as shown in FIG. 5, by grasping and holding housing 12 as one would hold a pen or pencil. On/off switch 26 is then moved to the "on" position so that crescent-shaped abrasive element 46 oscillates, as shown in FIG. 7 in a given arc. The tip 52 of cuticle guide 44 is placed beneath cuticle 54 to the extent thereof and the manicuring device moved along the cuticle by the operator using cuticle guide 44 as a guide therefor, resulting in a very neat and expert-like manicure. It should be noted that, because of its extremely simple operation, the cuticle manicuring device 10 of the present invention can be utilized in either hand of the operator without difficulty. Furthermore, since no cutting of the cuticle is involved, but rather a sweeping filing action occurs, the cuticle subsequently grows back in a very even condition rather than a ragged condition which would result from the cutting thereof with a sharp instrument.

While the abrasive element is shown coupled through shaft 48 to a motor driven cam, it is also possible to use other vibrating means to vibrate abrasive element 46. For example, certain vibrating elements used in electrical dry shavers, such as that found in U.S. Pat. Nos. 3,587,596; 2,936,768; and 3,081,782, could also be used. Moreover, the vibrating mechanism could also utilize an interrupted electromagnet having an armature which is coupled to drive shaft 48 as is shown in U.S. Pat. No. 1,719,063.

While only a single embodiment of the present invention has been shown and described, it will be obvious that many changes and modifications may be made thereunto without departing from the spirit and scope of the invention.

What is claimed is:

1. A cuticle manicuring device, comprising:
(a) an elongated housing adapted to be hand-held;
(b) a vibrating motor housed within said housing;
(c) a vibrating stem operatively connected to said vibrating motor to oscillate in a single plane and extending axially from a first end of said housing;
(d) a crescent shaped abrasive element disposed on the distal end of said vibrating stem; and
(e) a cuticle guide extending from said first end of said housing substantially parallel to said vibrating stem, said guide having a breadth parallel to the plane of the oscillations of said vibrating stem to support said abrasive element thereon, the tip of said guide having the shape of a point extending beyond said abrasive element to engage beneath a cuticle to be manicured so as to establish a limit stop for said abrasive element.

2. The cuticle manicuring device as defined in claim 1, wherein the extension of said cuticle guide from said first end of said housing is adjustable so that the extension of the tip thereof beyond the abrasive element is adjustable.

3. The cuticle manicuring device as defined in claim 2, wherein the adjustment of said cuticle guide comprises an elongated slot in said housing serving as a guide track and locking means for locking the position of said guide relative to said slot.

4. The cuticle manicuring device as defined in claim 1, wherein said cuticle guide is in the shape of an arrowhead the breadth of which supports said abrasive element in its oscillations.

5. The cuticle manicuring device as defined in claim 1, which further includes a cap covering said vibrating stem and said cuticle guide and which frictionally circumferentially engages with said housing to be retained thereon.

6. The cuticle manicuring device as defined in claim 5, wherein said cap further includes a retractable cuticle lifter.

7. The cuticle manicuring device as defined in claim 6, wherein said cuticle lifter is operated by a button extending therefrom through a longitudinal slot in said cap.

8. The cuticle manicuring device as defined in claim 1, wherein said vibrating motor is electrically powered.

9. The cuticle manicuring device as defined in claim 8, wherein the electrical power for said vibrating motor is supplied by a battery housed in said housing.

10. The cuticle manicuring device as defined in claim 9, wherein said battery is rechargeable by a battery charger.

11. The cuticle manicuring device as defined in claim 10, wherein said battery charger is in a stand for said cuticle manicuring device.

12. The cuticle manicuring device as defined in claim 1, wherein said abrasive element is of diamond dust construction.

13. The cuticle manicuring device as defined in claim 1, wherein said abrasive element is of sapphire dust construction.

* * * * *